United States Patent [19]

Wright

[11] Patent Number: 4,958,729

[45] Date of Patent: Sep. 25, 1990

[54] BALL GLOVE CONDITIONING BAG

[75] Inventor: Robert L. Wright, Des Moines, Iowa

[73] Assignee: Creative Athletic Products & Services, Inc., Des Moines, Iowa

[21] Appl. No.: 441,878

[22] Filed: Nov. 27, 1989

Related U.S. Application Data

[63] Continuation-in-part of Ser. No. 371,748, Jun. 27, 1989, Pat. No. 4,883,170.

[51] Int. Cl.[5] ..... B65D 85/18; B65D 81/22

[52] U.S. Cl. ..... 206/315.1; 2/19; 8/94.23; 206/213; 206/278; 223/78; 239/55

[58] Field of Search ..... 206/205, 207, 213, 213.1, 206/278, 315.1, 315.9, 216; 2/19; 223/78, 80, 84; 8/94.21-94.23; 383/902; 239/53, 55

[56] References Cited

U.S. PATENT DOCUMENTS

| | | | |
|---|---|---|---|
| 1,462,906 | 7/1923 | Graeff | 206/315.1 |
| 1,648,657 | 11/1927 | Mock | 206/213.1 |
| 2,215,988 | 9/1940 | Vivaudou et al. | 239/55 |
| 2,270,603 | 1/1942 | Ridder | 206/205 X |
| 2,342,406 | 2/1944 | LaHa et al. | 206/278 X |
| 3,706,140 | 12/1972 | Brillaud et al. | 239/55 X |
| 4,061,170 | 12/1977 | Marks | 206/278 |
| 4,382,508 | 5/1983 | Robbins et al. | 206/216 |
| 4,418,849 | 12/1983 | Santa | 223/278 |
| 4,565,287 | 1/1986 | Rede et al. | 206/213 |
| 4,765,519 | 8/1988 | Groves | 223/78 |

*Primary Examiner*—Bryon P. Gehman

*Attorney, Agent, or Firm*—Zarley, McKee, Thomte, Voorhees & Sease

[57] ABSTRACT

Year round conditioning and shaping of a ball glove is accomplished through use of the conditioning bag which includes on its bottom wall straps which hold the glove in spaced relationship to the side walls which contain a foam liner containing conditioning oil. A conditioning fluid ball applicator is placed in the pocket of the glove to shape the pocket and also transfer conditioning oil to the leather material in the pocket. The conditioning fluid ball applicator may include a hollow substantially rigid ball disposed in a tube of conditioning fluid absorbent material. A portion of the tube may be positioned on the front and back sides of the web.

9 Claims, 4 Drawing Sheets

BALL GLOVE CONDITIONING BAG

BACKGROUND OF THE INVENTION

A baseball or softball glove will play like new and give many years of use if given proper care on a year round basis. The glove needs to be kept clean, soft and shaped to receive a ball. When the glove is not being used it should be stored in a fashion that its softness and shape will be restored such that it is ready for the next use.

Often the application of conditioning oils to the glove is done on an inconsistent basis. Over the winter months when the glove is not used it will usually be laid aside on a shelf in a closet and perhaps even flattened by other items being placed on top of it.

What is needed is a convenient inexpensive way of conditioning and storing the glove from day to day when being used and for longer periods of nonuse.

SUMMARY OF THE INVENTION

A bag is provided which has fastening means on the bottom wall for holding the glove centered in the bag chamber equally spaced from the upwardly converging side walls. A ball of foam material containing conditioning oil such as neat's-foot oil is placed in the glove and the fastening means is wrapped around the glove to shape the glove around the ball. Conditioning oil is transferred from the ball to the pocket of the glove.

The walls of the bag include a liner of foam material also containing conditioning oil which establishes a moist, oily environment in the chamber of the bag thereby treating the entire glove. The glove is preferably spaced from the side walls in order to avoid excess conditioning oil being applied to the backside of the glove and causing discoloration. Discoloration in the pocket is normal.

The fastening means in the bag chamber attached to the bottom wall are spaced apart and have hook-and-eye, velcro-type separable fasteners which are arranged in a FIG. 8 criss-cross fashion.

Containers for the neat's-foot oil and a cleaning fluid are provided in the bag in separate holders on the sidewalls. A pocket is provided on the outside of the bag for holding instructions on proper care for the glove.

An alternative applicator ball may include a hollow substantially rigid ball disposed in a conditioning fluid absorbent tube. The tube may have a portion extending beyond the ball disposed in the closed end such that the tube portion extends outwardly over the ends of the fingers in the web area and inwardly along the backside of the fingers between the bottom wall of the bag and the glove. The tube may also be used as a conditioning fluid applicator by placing a person's hand into the tube and wiping fluids onto the glove.

DESCRIPTION OF THE PREFERRED EMBODIMENT

Figure 1:
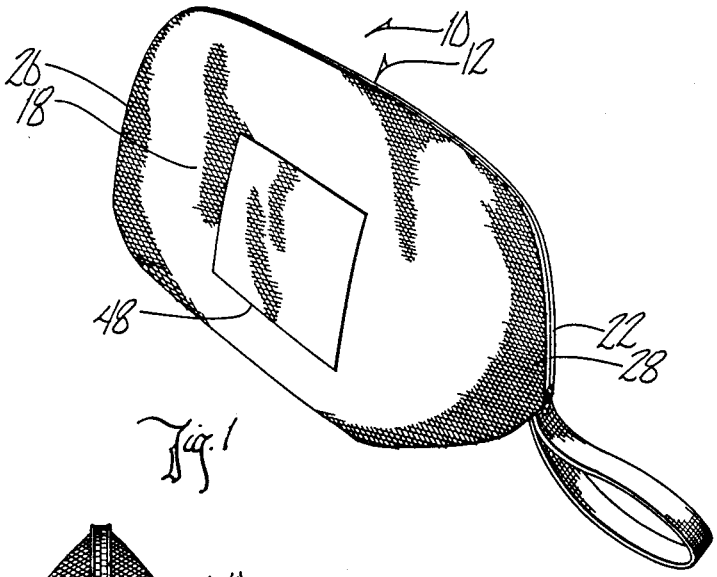
FIG. 1, is a perspective view of the ball glove conditioning bag.
Figure 2:
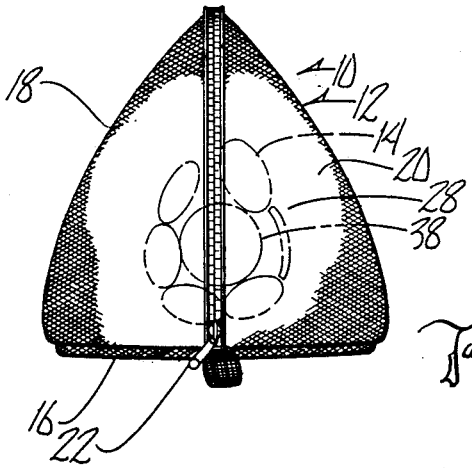
FIG. 2 is an end elevational view thereof from the right end of FIG. 1.
Figure 3:
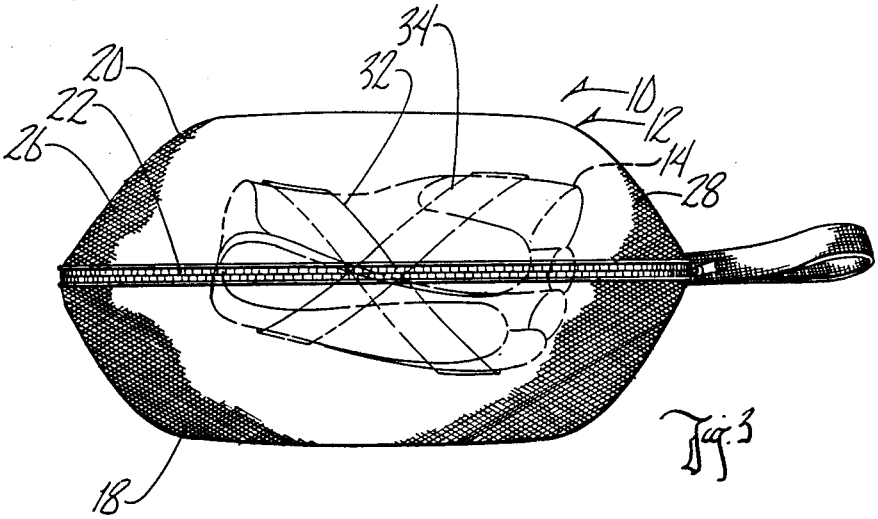
FIG. 3 is a top-plan view thereof.

The ball glove and glove conditioning bag of this invention is referred to generally in FIG. 1 by the reference numeral 10.

Figure 4:
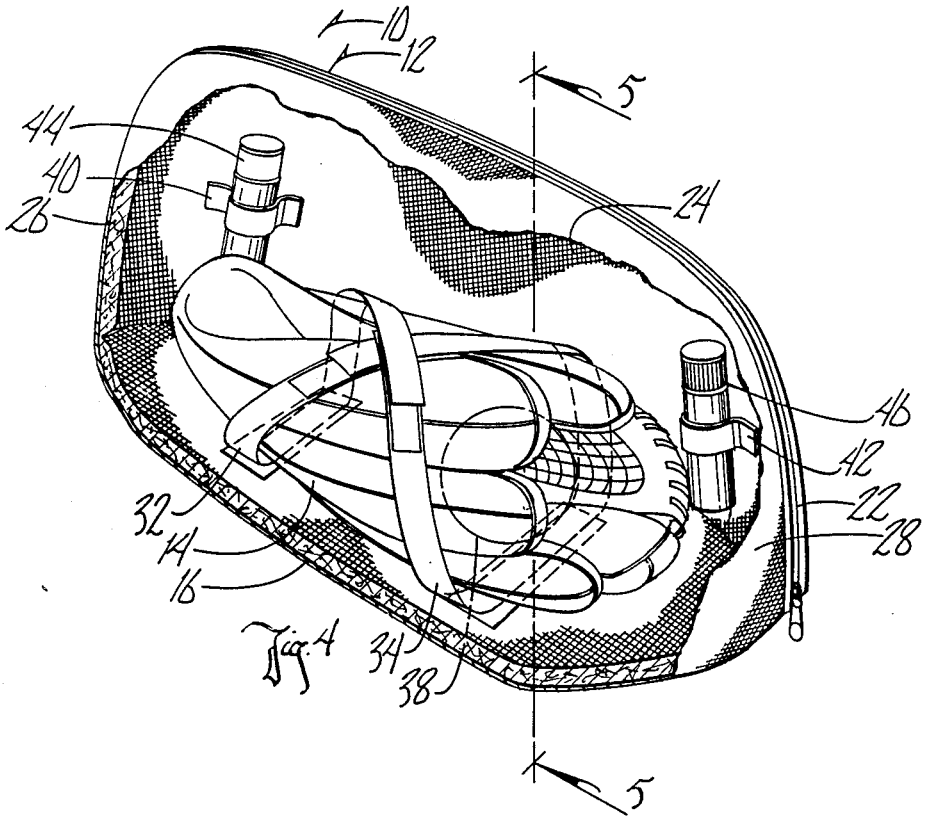
FIG. 4 is a fragmentary perspective view similar to FIG. 1 showing the glove being held in place inside the bag.
Figure 5:
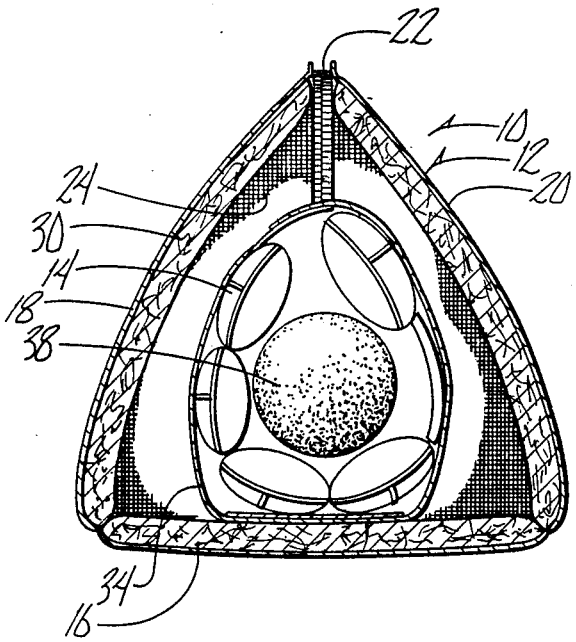
FIG. 5 is a cross-sectional view taken along line 5—5 in FIG. 4.
Figure 6:
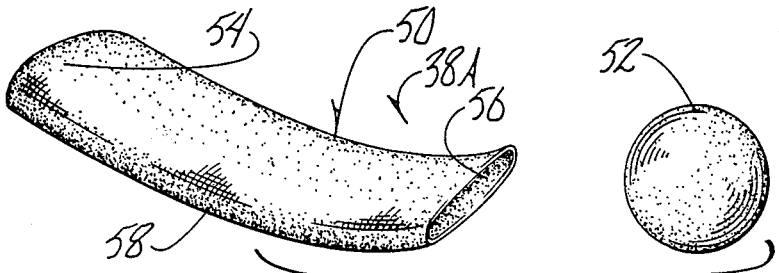
FIG. 6 is a perspective view of an alternate embodiment of the ball tube of conditioning fluid absorbent material and ball.
Figure 7:
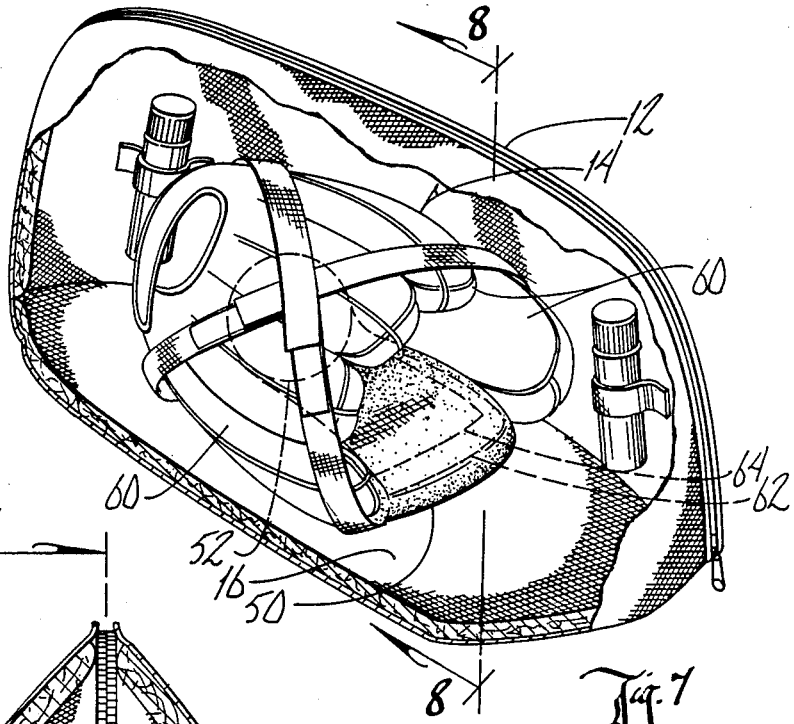
FIG. 7 is an exploded perspective view of the tube and ball of FIG. 6 in use.
Figure 8:
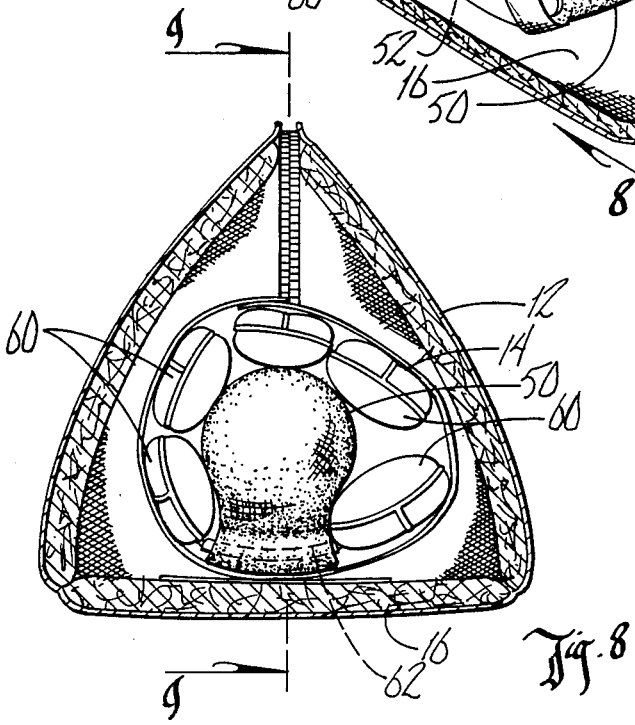
FIG. 8 is a cross-sectional view taken along line 8—8 in FIG. 7.
Figure 9:
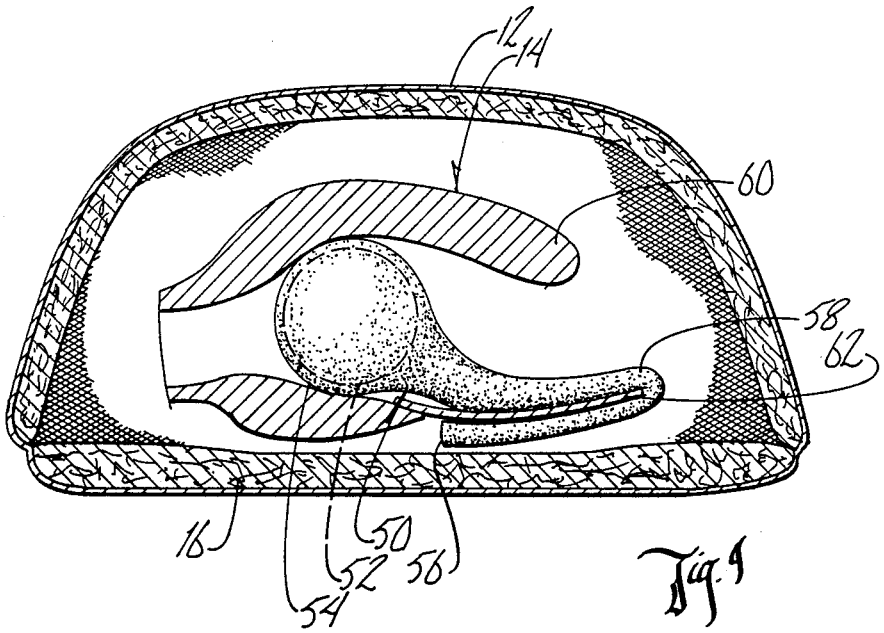
FIG. 9 is a cross-sectional view taken along line 9—9 in FIG. 8.

In FIG. 4 it is seen that a bag 12 is provided which contains a ball glove 14. The bag 12 has a bottom wall 16 and opposite side walls 18 and 20 which extend from the opposite sides of the bottom wall 16 and converge upwardly to a zipper closure 22 which extends the substantial length of the side walls and bottom wall to provide access into a chamber 24 in the bag 12. The converging side walls 18 and 20 also form end walls 26 and 28.

The walls of the bag each have an inside liner 30 of foam material which contains a conditioning oil such as neat's-foot.

A pair of spaced apart fastening straps 32 and 34 are secured to the bottom wall 16 and extend in a figure eight, criss-cross fashion around the glove 14 to hold it stationary and in substantial spaced relationship to the side walls.

An oil applicator ball 38 of foam material is positioned in the pocket of the glove whereby the straps 32 and 34, extending around the glove, shape the glove around the ball while at the same time transferring conditioning oil from the ball to the pocket of the glove. The conditioning oil in the foam liner 30 creates an oily environment in the chamber 24 and serves to keep the entire glove soft and pliable. Direct contact with excessive oil is avoided on the backside of the glove by keeping it spaced from direct contact with the side walls. This way discoloration of the backside of the glove will be avoided while it is normal on the front or pocket side of the glove. It may be desirable not to provide oil in the foam on the bottom wall 16 on which the glove is placed.

The side wall 18 on the inside face, as seen in FIG. 4, contains at opposite ends straps 40 and 42 for holding containers of oil and cleaning fluid 44 and 46 respectively. A pocket 48 is provided on the outside of the bag as seen in FIG. 1 for holding an instruction book on care of a ball glove through use of the conditioning bag of this invention.

It is thus seen in operation that the bag 12 of this invention provides a simple, inexpensive but effective way to care for a ball glove on a daily basis in between uses of the glove or for extended periods of time when the glove is not being used.

In FIGS. 6–10 an alternative embodiment of the applicator ball 38 is shown and is referred to generally by the reference numeral 38A. The applicator ball 38A includes a tube 50 of conditioning fluid absorbent material such as cotton. A ball 52 is provided which is hollow and made from a material sufficiently rigid to retain its ball shape when pressure is applied to it during use.

The ball 52 is placed into the tube 50 and positioned at a closed end 54 opposite the open end 56. A tube portion 58 extends beyond the ball 52 in the closed end 54.

Figure 10:
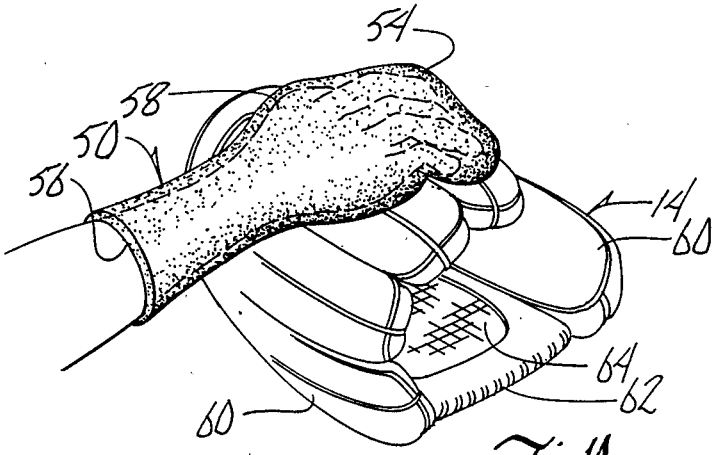
FIG. 10 is a perspective view showing the tube being used as a conditioning fluid applicator on the glove.

The glove 14 includes a plurality of fingers 60 with a web 62 interconnecting two of the adjacent fingers as seen in FIG. 10. The tube portion 58 extends outwardly along the inside face 64 of the web and then extends inwardly along the back side where it is positioned between the web 62 and the bottom wall 16 of the bag 12.

In FIG. 10 it is seen that the tube 50 may be used as a conditioning fluid applicator by placing a hand in it and rubbing conditioning fluid on the glove.

I claim:

1. A ball glove and glove conditioning bag comprising, a bag having a chamber defined by a bottom wall and side walls, and an access opening into said bag, a ball glove in said chamber, fastening means in said bag for holding said glove stationary and substantially centered between said side walls, a conditioning fluid applicator in the pocket of said glove, said applicator, including a tube of conditioning fluid absorbent material, said tube having an open end and a closed end and said a ball is disposed in said closed end of said tube, and said fastening means holding said glove in a wrapped-around-said-ball relationship whereby conditioning fluid may be transferred from said applicator to said glove.

2. The structure of claim 1 wherein said glove includes a plurality of fingers which form said pocket in said glove, said tube including a portion extending beyond said ball and said portion is extended from the pocket outwardly over the ends of said fingers for application of conditioning fluid to said fingers.

3. The structure of claim 2 wherein said fingers include a web having front and back sides interconnecting adjacent fingers and said tube portion extends over the front side of said web.

4. The structure of claim 3 wherein said tube portion after extending over the front side of said web then extends inwardly along the back side of said web.

5. The structure of claim 4 wherein said ball is hollow and sufficiently rigid that it will keep its ball shape during use.

6. The structure of claim 4 wherein said tube portion is further defined as being positioned between the back side of said web and the bottom wall of said chamber.

7. The structure of claim 4 wherein the material of said tube includes conditioning oil for application to said glove.

8. The structure of claim 1 wherein said ball is hollow and sufficiently rigid that it will keep its ball shape during use.

9. The structure of claim 1 wherein the material of said tube includes conditioning oil for application to said glove.

* * * * *